US007554307B2

(12) United States Patent
Moraveji

(10) Patent No.: US 7,554,307 B2
(45) Date of Patent: Jun. 30, 2009

(54) LOW DROPOUT LINEAR REGULATOR HAVING HIGH POWER SUPPLY REJECTION AND LOW QUIESCENT CURRENT

(75) Inventor: Farhood Moraveji, Saratoga, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 232 days.

(21) Appl. No.: 11/455,022

(22) Filed: Jun. 15, 2006

(65) Prior Publication Data

US 2007/0290665 A1 Dec. 20, 2007

(51) Int. Cl.
*G05F 1/00* (2006.01)

(52) U.S. Cl. ..... 323/280; 323/281

(58) Field of Classification Search ..... 323/280, 323/281, 312, 316

See application file for complete search history.

(56) References Cited

U.S. PATENT DOCUMENTS

| | | | | |
|---|---|---|---|---|
| 6,690,147 | B2 * | 2/2004 | Bonto | 323/280 |
| 6,933,708 | B2 * | 8/2005 | Hamon et al. | 323/280 |
| 6,969,982 | B1 * | 11/2005 | Caldwell | 323/313 |
| 6,977,490 | B1 * | 12/2005 | Zhang et al. | 323/280 |
| 7,088,082 | B2 * | 8/2006 | Jung | 323/275 |
| 7,135,912 | B2 * | 11/2006 | Perez | 327/541 |

* cited by examiner

*Primary Examiner*—Shawn Riley
(74) *Attorney, Agent, or Firm*—Perkins Coie LLP

(57) ABSTRACT

Methods and apparatus are disclosed for providing stable voltage references from within a low dropout voltage regulator. Some embodiments utilize dependable semiconductor inherent attributes to generate a voltage reference, such as a band-gap voltage reference.

3 Claims, 3 Drawing Sheets

LOW DROPOUT LINEAR REGULATOR HAVING HIGH POWER SUPPLY REJECTION AND LOW QUIESCENT CURRENT

TECHNICAL FIELD

Disclosed embodiments relate, in general, to low dropout (LDO) linear voltage regulators and, in particular, to voltage regulators with an internal reference voltage.

BACKGROUND

Almost all electronic devices contain a regulated power supply, which are typically designed to match the requirements of the electronic devices. An important part of these power supplies is a voltage regulator, which functions to maintain their output voltage and/or current within a desired range. A linear regulator is a voltage regulator based on an active device such as a bipolar junction transistor or field effect transistor operating in its "linear region." A linear regulating device acts substantially like a variable resistor.

A low dropout or LDO regulator is a DC linear voltage regulator which has a very small input-output differential voltage. The regulator dropout voltage determines the lowest usable supply voltage. Due to the increased demand regarding efficiency and the growing problems with the power dissipation in today's systems, low dropout regulators (LDOs) are the preferred choice among linear regulators. Another important characteristic is the quiescent current, or the current flowing through the system when no load is present. Quiescent current causes a difference between the input and output currents. Quiescent current limits the efficiency of the LDO regulators and, thus, should be minimized.

An important part of most voltage regulators is a voltage reference, which provides a reference voltage that is compared against the output of the voltage regulator. Circuitry within the voltage regulator controls the output of the voltage regulator to follow the voltage reference at all times. Therefore, changes of the voltage reference directly and undesirably affect the voltage output of the regulator.

DETAILED DESCRIPTION

The following disclosed embodiments describe stable and low dropout voltage regulators that also generate their own voltage references. Some embodiments utilize semiconductor inherent attributes to generate the voltage references.

In the following description, numerous specific details are provided, such as the identification of various system components, to provide a thorough understanding of embodiments of the invention. One skilled in the art will recognize, however, that the invention can be practiced without one or more of the specific details, or with other methods, components, materials, etc. In some instances, well-known structures, materials, or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
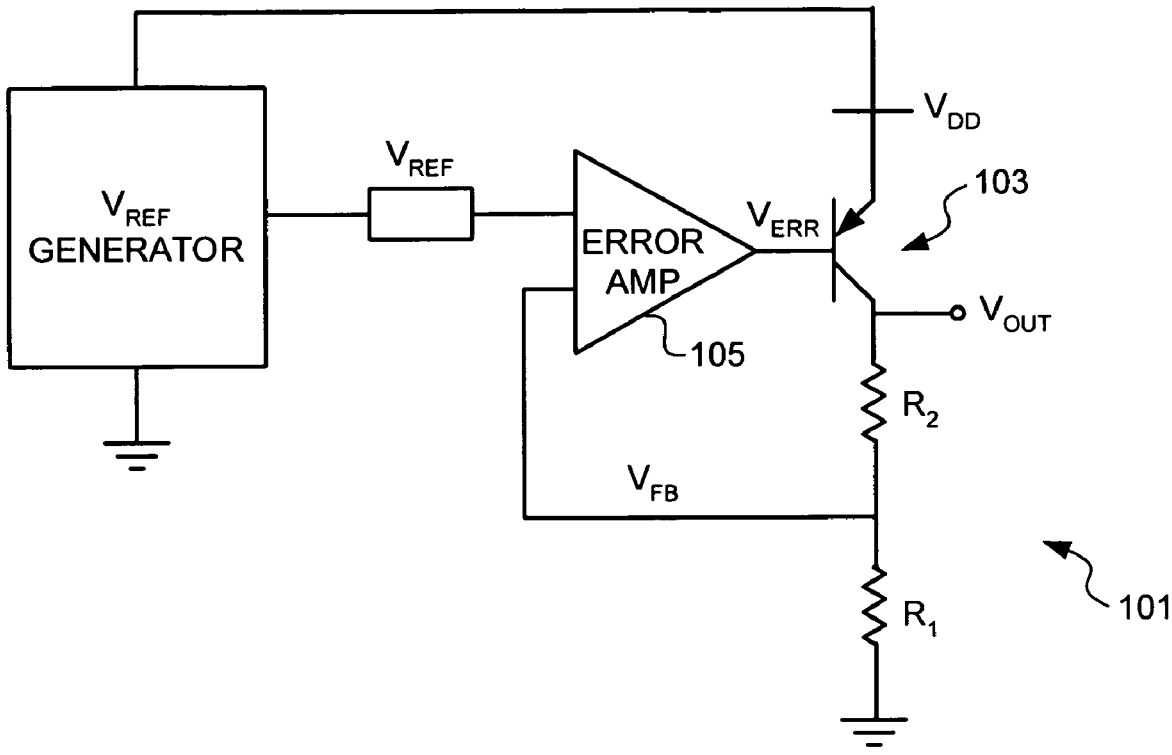
FIGURE 1 (PRIOR ART)
FIG. 1 is a circuit diagram of a prior art linear voltage regulator.

FIG. 1 shows a typical prior art implementation of a linear DC/DC voltage regulator which employs a classical negative-feedback closed-loop control system to keep the output voltage $V_{out}$ at a desired level, where $V_{out}$ is dictated by a reference voltage $V_{ref}$. In the feedback part of the circuit of FIG. 1, a fraction of the output voltage, $V_{fb}$, is fed back to an error amplifier 105. Resistors R1 and R2 produce the feedback gain and determine what fraction of $V_{out}$ is fed back as $V_{fb}$, where $V_{fb}=V_{out}\times R1/(R1+R2)$.

In the feed-forward part of the circuit of FIG. 1, an error amplifier 105 compares $V_{fb}$ with the reference voltage $V_{ref}$ and amplifies the resulting deviation/error to generate an error voltage $V_{err}$. In the feed-forward part of the circuit of FIG. 1, the actuating signal $V_{err}$ is used to drive transistor 103, which acts as an actuator in this control system. Transistor 103 regulates the amount of current passing through R1 and R2 and, therefore, generates the output voltage $V_{out}$.

In this classical closed-loop control system, any change of $V_{out}$ generates an error signal $V_{err}$ which forces $V_{out}$ back to its designated level. A drop in $V_{out}$ causes an increase in $V_{err}$, subsequently an increase in the current passing through R1 and R2. And a rise in $V_{out}$ causes a drop in $V_{err}$ and subsequently a drop in the current passing through R1 and R2. Because the circuit continuously keeps $V_{fb}$ equal to $V_{ref}$, and since $V_{fb}=V_{out}\times R1/(R1+R2)$, therefore, $V_{out}=V_{ref}(1+R_2/R_1)$.

As seen from the above equation, the bottle neck in the performance of the voltage regulator of FIG. 1 is the stability of the reference voltage $V_{ref}$. Such circuit performs very well in terms of following the reference voltage; however, providing a dependable and a stable reference voltage is another matter altogether and is a burden on the user of the voltage regulator. For example, as illustrated in FIG. 1, any change of the $V_{dd}$ will change $V_{ref}$ via the $V_{ref}$ generator and a $V_{ref}$ change is as much as $V_{ref}+\Delta V_{dd}/(PSRR\times V_{ref})$, where PSRR is the power supply rejection ratio of the $V_{ref}$ generator circuit. As can be seen, to obtain a stable $V_{ref}$, PSRR should be very large.

The following disclosed embodiments provide stable voltage references from within the voltage regulating circuit. Some embodiments employ dependable semiconductor inherent attributes to generate a voltage reference, such as a band-gap voltage reference.

Figure 2:
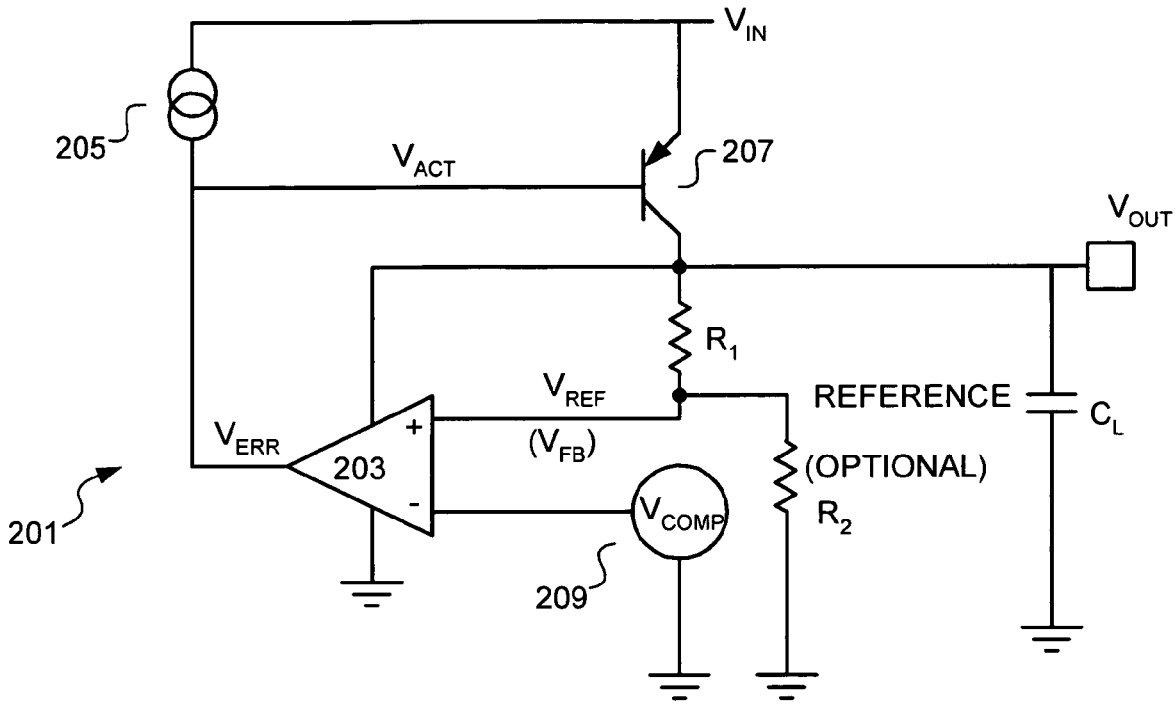
FIG. 2 is a high-level circuit diagram of a LDO voltage regulator in accordance with an embodiment of the invention.

FIG. 2 is a simplified high-level circuit diagram of an LDO voltage regulator in accordance with an embodiment of the present invention. In FIG. 2, while reference voltage $V_{comp}$, 209, is illustrated separately, it is not to be provided from the outside of the circuit and $V_{ref}$ is derived from the regulated output voltage $V_{out}$, which significantly enhances the PSRR. As will become clearer from FIG. 3, $V_{comp}$ is also generated within the circuit and is regulated by the error amplifier 203. In some embodiments $V_{comp}$ is a part of the error amplifier 203.

FIG. 2 also illustrates a control loop, wherein $V_{fb}$ is a feedback signal that carries some information regarding the output voltage $V_{out}$ to an error amplifier 203. Resistors R1 and R2 determine the feedback gain and are employed to send back only a fraction of $V_{out}$. Resistor R2 is optional if $V_{out}$ is to be fed back without significant reduction.

In the circuit of FIG. 2, the feedback signal $V_{fb}$ is compared with the internally generated reference voltage $V_{comp}$ and is amplified to produce an error signal $V_{err}$. The error signal $V_{err}$, with the assistance of the current source 205, which may be a cascade of current sources, produces an actuating signal $V_{act}$ that controls transistor 207. In the control loop of FIG. 2, transistor 207 acts as an actuator that regulates the flow of current through R1 and also to the output. Note that the error signal $V_{err}$ and/or $V_{act}$ may be voltage or current signals.

Figure 3:
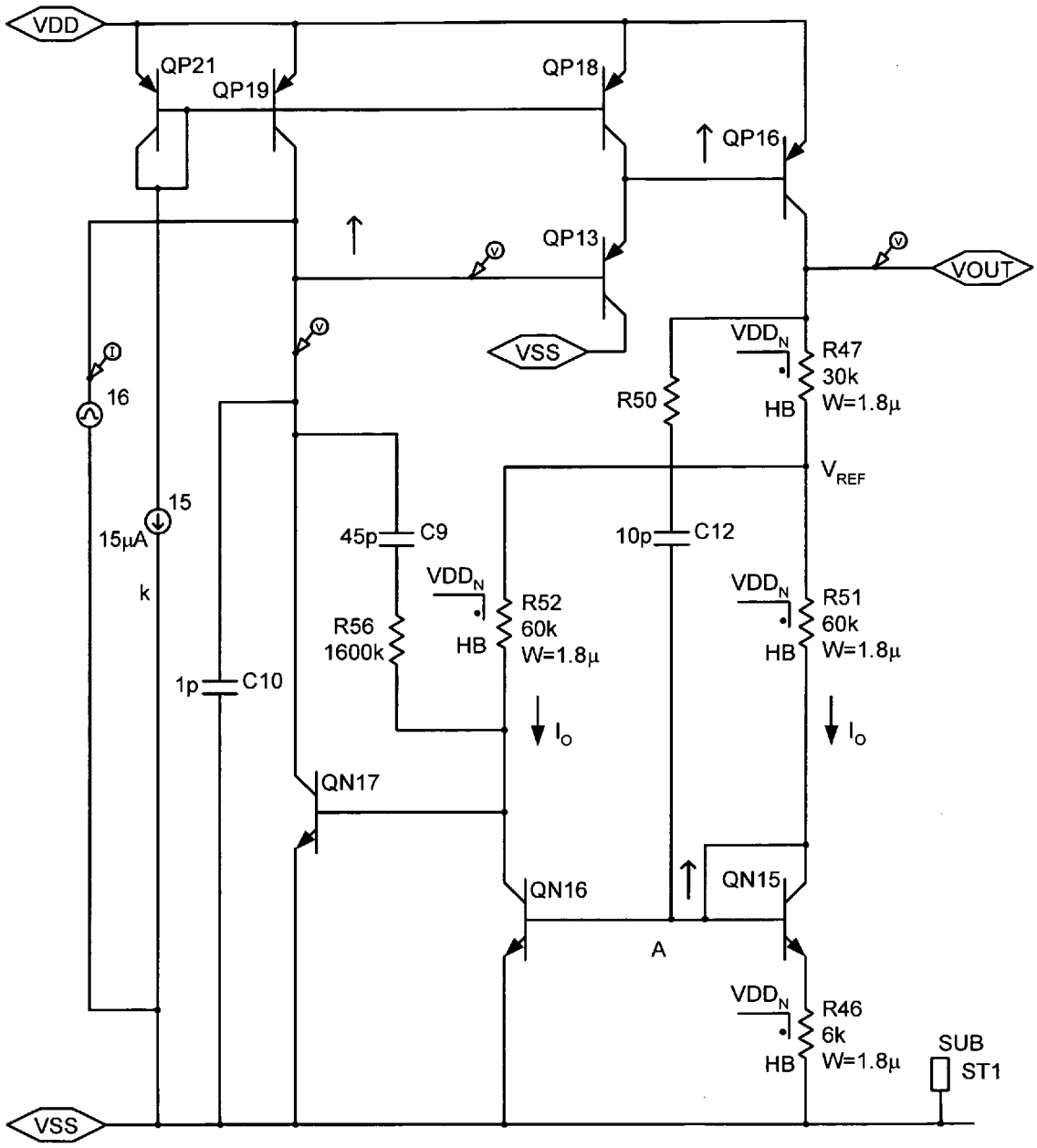
FIG. 3 a detail circuit diagram of the LDO voltage regulator of FIG. 2.

FIG. 3 is a more detailed circuit diagram of the LDO linear regulator 201, depicted in FIG. 2. The pass transistor 207 is designated as QP16. Transistors QP13 and QN17 are used to help drive the pass transistor QP16, and also contribute to the error amplification process. Transistors QP13 and QN17 are in the feedback path for controlling transistor QP16. Transistors QP18 and QP21 form a current source. Transistors QP21 and QP19 also form another current source.

The current through resistor R47 is determined by adding the currents through R51 and R52, which are the two branches of a current mirror that is partially defined by transistors QN15 and QN16. Because in this current mirror the currents through R51 and R52 are equal and the same current passes through R51 and R46, the current through the resistor R47 will be equal to two times the current passing through the resistor R46. The voltage across R46 is equal to the difference of the base-emitter voltage of QN15 and QN16. Therefore, the current through R46 can be written as:

$$V_{R46}=V_{BE(QN16)}-V_{BE(QN15)}=\Delta V_{BE}=V_T\ln 10,$$

which is about 60 mv at room temperature. Therefore $I_{R46}$ can be written as:

$$I_{R46}=V_{R46}/R46=\Delta V_{BE}/R46=V_T\ln 10/R46=I_o$$

or as $I_{R46}=I_{R51}=\frac{1}{2}I_{R47}$, which results in: $I_{R47}=2\Delta V_{BE}/R46$.

Furthermore, $V_{ref}$ can be written as:

$$\begin{aligned} V_{ref} &= V_{BE(QN16)} + I_o \times R52 \\ &= V_{BE(QN16)} + (V_T\ln 10) \times R52/R46, \quad \text{or} \\ &= V_{BE(QN16)} + I_{R46} \times R51. \end{aligned}$$

Therefore, the voltage at the output can be written as:

$$\begin{aligned} V_{out} &= V_{ref} + I_{R47} \times R47, \text{ or} \\ &= V_{BE(QN16)} + I_{R46} \times R51 + I_{R47} \times R47 \\ &= V_{BE(QN16)} + \Delta V_{BE} \times R51/R46 + 2\Delta V_{BE} \times R47/R46 \\ &= V_{BE(QN16)} + \Delta V_{BE}(R51 + 2\ R47)/R46 \\ &= V_{BE(QN16)} + (V_T\ln 10)(R51 + 2\ R47)/R46. \end{aligned}$$

As evident from the above equation, a low $V_{out}$ can be achieved by choosing different resistor values.

In the example circuit of FIG. 3, $V_{out}=V_{BE(QN16)}+20\Delta V_{BE}$. Furthermore, in this embodiment any change in $V_{out}$ will translate into a change in $V_{ref}$ which affects the base of transistor QN17. The signals at the base of transistor QN17, in turn, send a similar signal to the base of transistor QP13, which controls transistor QP16 and which, in turn, regulates $V_{out}$.

The passage of these signals through QN17 and QP13 also amplifies the error signal originating from transistor QN16. Hence, the control loop of the voltage regulator of FIG. 3 utilizes the base-emitter voltage $V_{BE}$ and $\Delta V_{BE}$ of the current mirror transistors as the foundation of a stable reference voltage without resorting to any outside voltage reference.

I claim:

1. A low dropout voltage regulator, comprising:

a power source;

an output port having an output port voltage;

a first resistor;

a pass device coupled to the power source and the output port for controlling current from the power source to the output port;

an error amplifier that includes an internally generated reference voltage, wherein the error amplifier is in electrical communication with the output port through a the first resistor and senses a difference between the output port voltage and the internally generated reference voltage; and a feedback connection between the error amplifier and the pass device, wherein the feedback connection includes at least one current source to control the pass device based on the sensed difference between the output port voltage and the internally generated reference voltage;

wherein the error amplifier comprises:

a second resistor: a third resistor: a fourth resistor; and a current mirror comprising two NPN transistors, each of the two NPN transistors having emitters and collectors, an emitter of a first of the two NPN transistors connected to a lower voltage less than the power source voltage, and an emitter of a second of the two NPN transistor connected to the lower voltage through the second resistor, and collectors of the two NPN transistors connected to the first resistor through the third and fourth resistors.

2. A voltage regulator comprising:

an output port;

a power rail;

a ground rail;

a node;

a pass transistor having an emitter coupled to the power rail, a base, and a collector connected to the output port;

a first resistor having a first terminal connected to the collector of the pass transistor, and having a second terminal connected to the node;

a second resistor having a first terminal connected to the node and having a second terminal;

a third resistor having a first terminal connected to node and having a second terminal; and a first current mirror comprising:

a first transistor having a collector connected to the second terminal of the second resistor, having a base, and having and an emitter connected to the ground rail; and a second transistor having a collector connected to the second terminal of the third resistor, having a base connected to the base of the first transistor of the first current mirror and to the collector of the second transistor of the first current mirror, and having and an emitter;

a fourth resistor having a first terminal connected to the emitter of the second transistor of the first current mirror, and having a second terminal connected to the ground rail.

3. The voltage regulator as set forth in claim 2, further comprising:

a second transistor having an emitter connected to the ground rail, a base connected to the second terminal of the second resistor, and a collector;

a second current mirror to provide current to the second transistor;

a third transistor having a collector connected to the ground rail, a base connected to the collector of the second transistor, and an emitter connected to the base of the pass transistor; and a fourth transistor having an emitter coupled to the power rail, a base coupled to the second current mirror, and a collector connected to the base of the pass transistor.

* * * * *